United States Patent [19]

Squires

[11] 4,402,301

[45] Sep. 6, 1983

[54] WOOD-BURNING STOVE

[76] Inventor: Wayman Squires, R.D. 3- Duke Rd., Calcutta, Ohio 43920

[21] Appl. No.: 202,127

[22] Filed: Oct. 30, 1980

[51] Int. Cl.[3] ..... F24B 11/00

[52] U.S. Cl. ..... 126/77; 126/80; 126/121; 126/123; 126/152 B; 126/193; 126/200

[58] Field of Search ..... 126/77, 83, 63, 67, 126/76, 127, 123, 164, 165, 143, 65, 66, 144, 152 B, 80, 193, 200

[56] References Cited

U.S. PATENT DOCUMENTS

| | | | |
|---|---|---|---|
| 1,382,667 | 6/1921 | Noeth | 126/77 |
| 2,530,095 | 11/1950 | Stevens | 126/65 |
| 4,121,560 | 10/1978 | Knight | 126/63 |
| 4,149,517 | 4/1979 | Horwinski | 126/63 |
| 4,157,704 | 6/1979 | Zimmer | 126/62 |
| 4,179,065 | 12/1979 | Zung | 126/121 |
| 4,194,487 | 3/1980 | Cadwallader et al. | 126/61 |
| 4,201,185 | 5/1980 | Black | 126/77 |
| 4,212,286 | 7/1980 | Shane et al. | 126/65 |
| 4,248,203 | 2/1981 | Willson | 126/77 |

*Primary Examiner*—Lee E. Barrett

*Attorney, Agent, or Firm*—Thomas H. Murray; Clifford A. Poff

[57] ABSTRACT

A wood-burning stove includes side walls joined together in an airtight manner to form a firebox and a heat chamber thereabove. The firebox contains upstanding rails to support wood logs for combustion. Streams of heated air are discharged from a manifold that extends from rail-to-rail outwardly from one terminal end of each rail between opposite side walls of the stove. A plate is adjusted to control the flow of air into the manifold. An access door has openings in a spacer side wall for supplying air as desired to the firebox. The spacer walls of the door support a glass panel at an outwardly-spaced location from a deflector to prevent deposits of creosote and other materials on the glass.

10 Claims, 8 Drawing Figures

FIG. 3
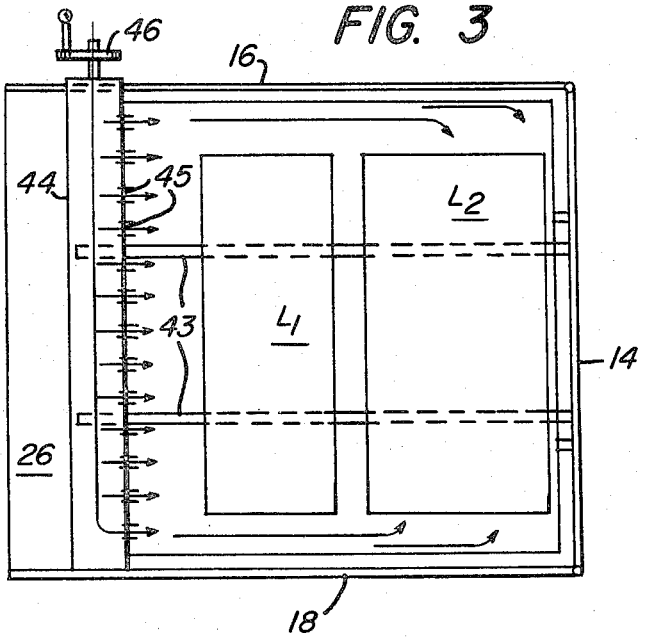
FIG. 4
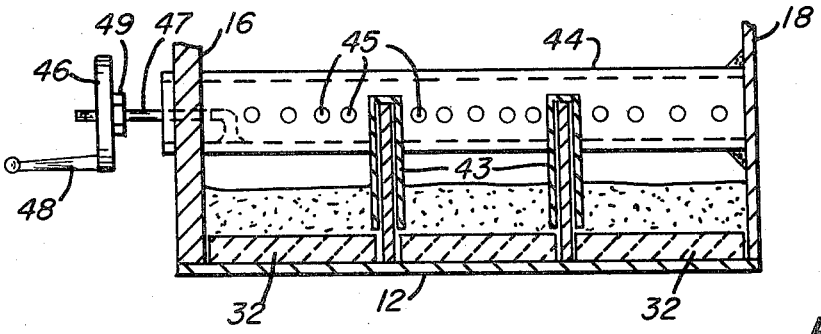
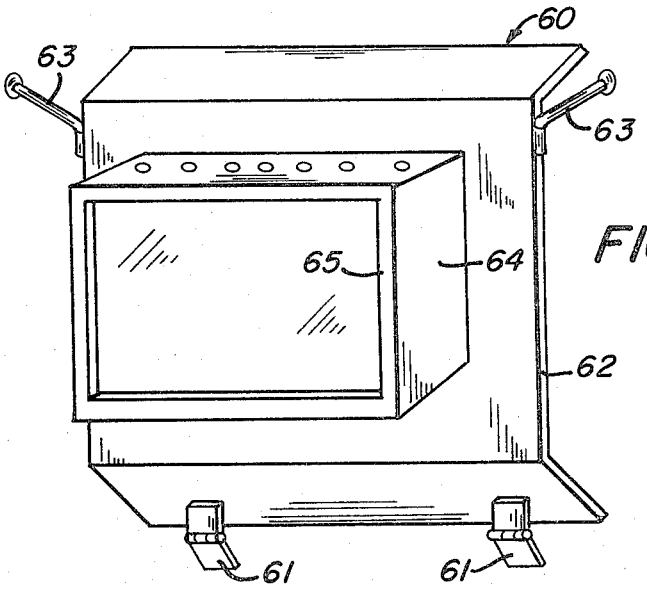
FIG. 5
FIG. 6
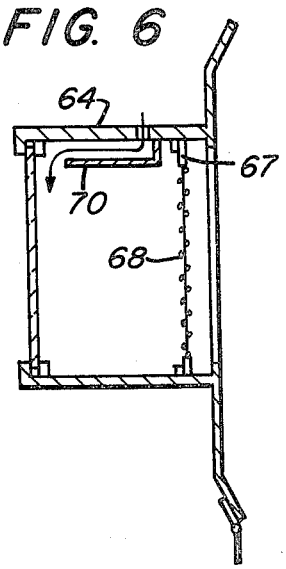

WOOD-BURNING STOVE

BACKGROUND OF THE INVENTION

The present invention relates to a stove apparatus for the combustion of solid fuel, such as wood logs, to provide heat for a dwelling or the like and, more particularly, to such a stove apparatus having walls joined together in a substantially airtight manner to form a firebox and heat chamber thereabove with an air-supply manifold provided with a plurality of spaced-apart, air-discharge openings to direct streams of heated air toward the fuel while supported in the firebox for the combustion process. The present invention further provides an improved access door to permit the loading of solid fuel into the firebox onto support rails having steel covers wherein the access door includes a frame with openings to feed an air supply into a space between high-temperature glass or the like and prevent deposits of material on the glass surface.

Known designs of wood-burning stoves failed to provide adequate control of the air supply to control the combustion process. Slide or rotary plate members were usually positioned at a convenient location sometimes dictated only to satisfy the aesthetic appearance for controlling a supply of air. One or more logs used for fuel are usually supported on a grating or directly on a fire-resistant floor space at a site which is distally spaced sometimes by as much as 10–12 inches from the opening provided to deliver the necessary air for combustion. Since the space within the stove walls is usually subject to a chimney draft, control of the air supply for the combustion process was erratic and fuel was consumed at a wastefully-excessive rate.

The present invention is based, in part, on the discovery that not only is it necessary to control the quantities of air which are supplied into a wood stove but also that the air supplies must be conducted to a point closely adjacent the supply of wood fuel for an effective control of the combustion process. A wood stove of this type must, therefore, be not only of robust construction for longevity but also the walls must be joined together in a substantially airtight manner. To enhance the aesthetic appeal provided by a burning wood stove, a hinged door has been provided in the past with a glass panel. The panel usually became opaque after a very short period of operation due to an accumulation of creosote, tar and other products liberated from the wood fuel during combustion. Cleaning of the glass panel can only be effected by access to the surface thereof directed toward the interior of the stove. The door, therefore, must be open during the time the surface of the glass is cleaned which substantially eliminates control of the combustion process and may even permit smoke emissions from the stove through the door opening. Thus, another aspect of the present invention is directed to providing an improved construction of an access door to prevent or at least minimize the accumulation of foreign matter on the internal face surface of a glass or other transparent panel.

SUMMARY OF THE INVENTION

It is an object of the present invention to provide a stove apparatus for the combustion of solid fuel, such as wood logs, while supported in a firebox formed by surrounding stove walls wherein the stove apparatus includes an air-supply manifold having a plurality of spaced-apart, air-discharge openings directed toward the fuel; the manifold extending through an opening in one of the stove walls to conduct the flow of air in or in close proximity to the firebox so that conductive heating of the air in the manifold occurs for the discharge of heated streams of air through the openings toward the fuel.

It is a further object of the present invention to provide a stove apparatus for the combustion of solid fuel such as wood logs wherein stove walls include an access door to normally close an opening therein used to supply fuel into a firebox of the stove where the access door includes a transparent panel made of glass or other high-temperature transparent material held by frame means at an outwardly-spaced relation from the side walls of the stove and openings in the door frame provide an airflow to maintain the glass panel free of creosote, soot and other materials liberated from the fuel during the burning process in the stove.

It is a still further object of the present invention to provide a stove apparatus for the combustion of solid fuel such as wood logs while supported within stove walls on raised rail surfaces having temperature-resistant covers, the rails extending above the stove floor or a lining of brick material by a distance sufficient to permit the formation of an ash bed to not only facilitate the combustion process but also reduce the need for ash removal.

More particularly, according to the present invention, there is provided a stove apparatus for combustion of solid fuel, such as wood logs, wherein the stove apparatus includes the combination of stove walls, including a floor wall joined together in a substantially airtight manner to form a firebox and a heat chamber thereabove, fuel carrier means extending in the firebox above the floor wall to support a fuel supply during burning, smoke pipe means coupled to an opening in one of the stove walls to carry away smoke and waste products of combustion, an access door to normally enclose an opening in at least one of the stove walls for supplying fuel to the firebox, an air-supply manifold having a plurality of spaced-apart discharge openings directed toward the fuel on the fuel carrier means, the air-supply manifold extending within the firebox to heat the flow of air in the manifold for discharging streams of heated air from the discharge openings, and means to control the flow of air in the manifold.

In its preferred form, the stove apparatus of the present invention provides that the fuel carrier means are embodied as spaced-apart upstanding rails with metal covers preferably constructed from stainless steel to cover the rails along their extended lengths above the floor wall. The air-supply manifold is preferably arranged from rail-to-rail outwardly from one terminal end of each rail such that a wood log, when supported by the rails, extends generally parallel with the air-supply manifold within the firebox. Each of the opposite ends of the manifold is supported by one opposed stove wall. An adjustable cover plate is preferably provided on the projecting end of the manifold from the stove wall to control the flow of air into the manifold. The access door, supported by hinge members, includes a front wall surrounding an aperture therein. A glass panel, glass strip or other transparent sheeting is held against the front wall of the door by supports with the front wall of the door. The glass panel is held at an outwardly-spaced location from a door flange by spaced side walls. The supports take the form of side walls having at least one, but preferably a plurality of spaced-apart air-supply openings to distribute a flow of air across the inside face of the glass panel. This air supply while contributing to the combustion process maintains the inside face surface of the glass panel free of deposits of foreign material which is also facilitated by arranging a deflector at an inwardly-spaced location from the panel. A door frame supported by the stove walls defines the actual opening that is normally closed by the access door.

The aforesaid air-supply manifold extends preferably between the terminal ends of the rails to support the fuel and the lower horizontal side of the door frame. A smoke curtain is supported to extend within a heat chamber by the horizontal side of the door frame. To enhance the flow of heat into a dwelling, an air-supply chamber is attached for support by one or more of the stove walls and a blower is coupled to direct an air supply into the chamber for discharge therefrom across the outside surface of one or more of the stove walls.

These features and advantages of the present invention as well as others will be more fully understood when the following description of the preferred embodiment is read in light of the accompanying drawings, in which:

FIG. 3 is a plan sectional view taken along line III—III of FIG. 1;

FIG. 4 is an enlarged view of the air-supply manifold taken along line IV—IV of FIG. 1;

FIG. 5 is an isometric view of the access door for the stove apparatus of the present invention;

FIG. 6 is an elevational view, in section, taken through the access door shown in FIG. 5;

Figure 1:
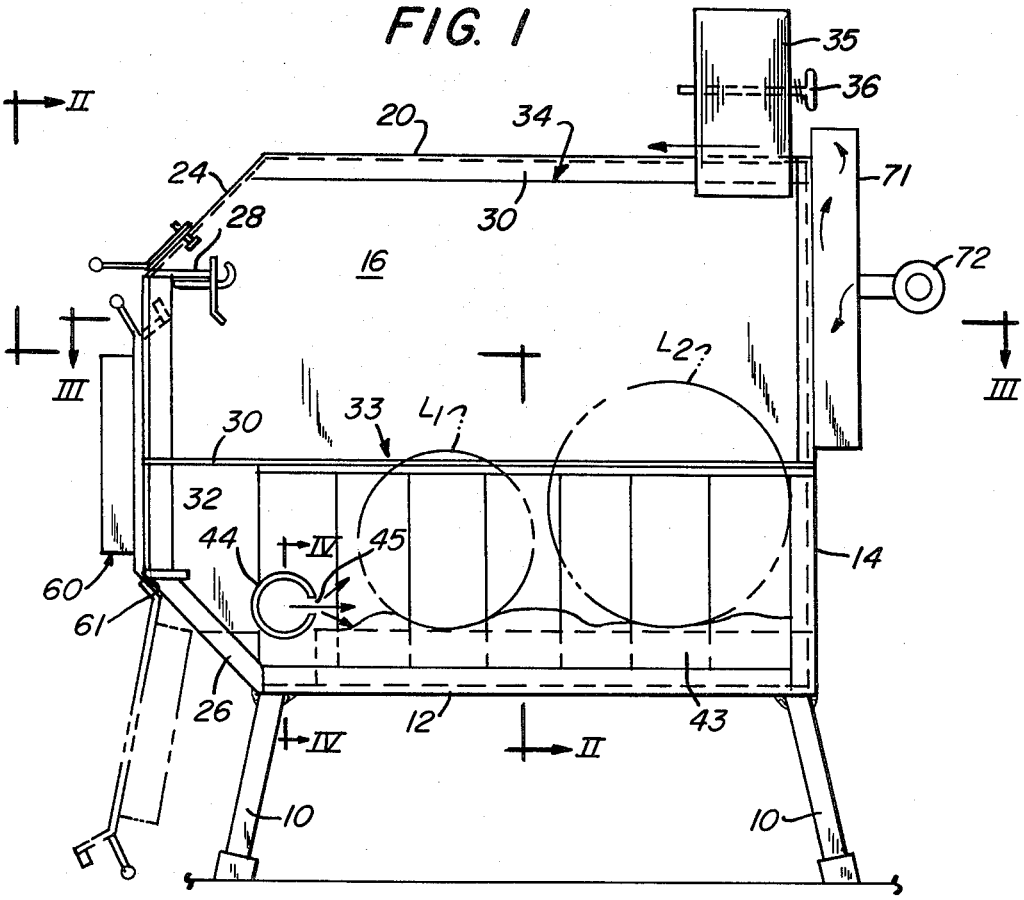
FIG. 1 is a side elevational view, in section, of the stove apparatus embodying the features of the present invention.
Figure 2:
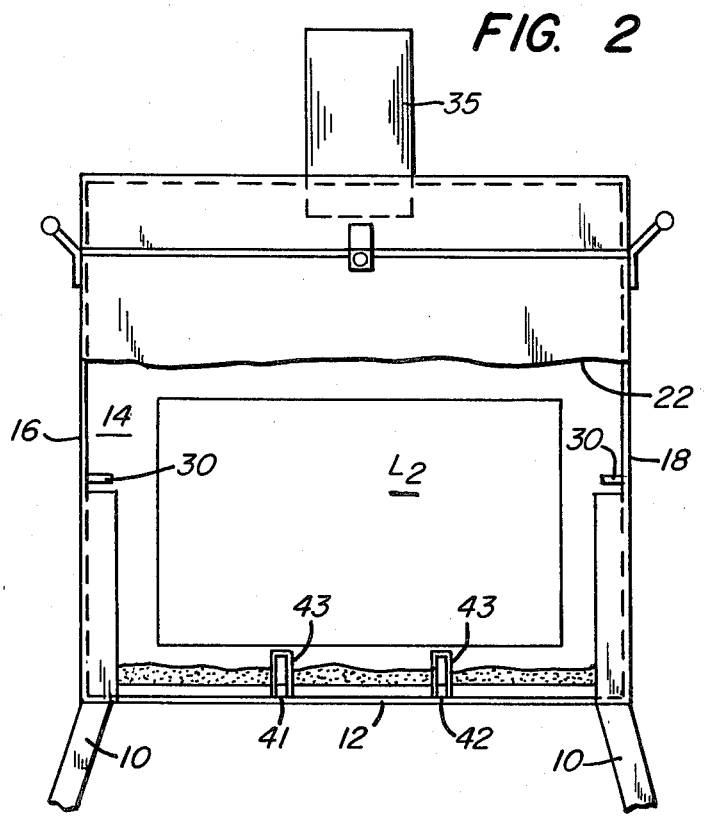
FIG. 2 is a front view, partly in section, taken along line II—II of FIG. 1.

In FIGS. 1 and 2, reference numeral 10 identifies stove legs typically made of suitable lengths of pipe. An enlarged foot member is supported on the lower end of each leg for engaging the hearth or other heat-resistant surface of a fireplace or other suitable support area adjacent a draft opening of a chimney. The legs support a floor wall 12 of the wood-burning stove at an elevation which is normally spaced above the hearth to permit conductively-driven air to circulate about the stove walls. The floor wall 12 is joined in an airtight manner by welding, for example, to a back wall 14 and spaced-apart side walls 16 and 18. A top wall 20 is joined to the back wall and side walls in an airtight manner by beads of weld. A front wall 22 includes upper and lower outwardly-projecting wall portions 24 and 26, respectively. A rectangular door frame 28 includes upper and lower horizontal sections welded to the projecting terminal edge of the front sections 24 and 26. Vertical sides of the door frame are welded to the edges of vertical front wall parts that extend between the front wall portions 24 and 26. Stiffener plates 30 are welded to the inside surfaces of the side walls 16 and 18, the roof 20 and back wall 14 to provide reinforced support for these walls and protect them against buckling due to a high-temperature environment.

As shown in FIGS. 1 and 2, a lining of firebrick 32 extends along the bottom portions of the side walls 16 and 18, back wall 14 and front wall section 26 to protect the metal forming these walls against the high temperature developed within a firebox 33. The firebox is generally defined within the area surrounded by the firebrick. A heat chamber 34 is formed by the area within the side walls above the firebox. The heat chamber is coupled by a smoke pipe 35 to a chimney for delivering waste products of combustion and smoke from the heat chamber and the firebox. The smoke pipe is tightly fitted into an opening formed in the top wall 20. The smoke pipe which may include a damper assembly 36 can be connected in a similar manner to an opening that is formed in the back wall or even a side wall to permit installation of the stove within a dwelling.

Attached to the floor wall 12 are spaced-apart and generally parallel rails 41 and 42 that project above the top surface of the refractory lining. Beads of weld are used to hold the rails at fixed positions so that they extend from an abutting or closely-spaced relation with the back wall 14 forwardly where they terminate forming a gap with front wall portion 26. Covers 43 made from metal, preferably stainless steel, have a U-shaped cross section to fit over and protect the exposed surfaces of each rail 41 and 42. An air-supply manifold 44 extends from rail-to-rail outwardly from the terminal end of each rail in the gap, as best shown in FIGS. 1, 3 and 4, in the firebox between the side walls 16 and 18. The manifold which is conveniently made from a suitable length of pipe is passed through an opening in side wall 16 to abut against the side wall 18 in a sealed relation typically established by an outer peripheral bead of weld metal. At the site where the manifold is passed through side wall 16, beads of weld are used to form a sealed connection. A plurality of drilled openings 45 is formed at spaced-apart locations in the side wall of the manifold and defines discharge openings to direct heated streams of air directly toward a wood log while supported on the rails 41 and 42.

In FIGS. 1 and 2, logs L1 and L2 which can be of relatively large diameter, e.g., 11 inches or more, extend in a generally parallel relation with the manifold. The discharge openings are distributed at closely-spaced intervals, e.g., between 1 and 2 inches, along the entire distance between the stove side walls so that the supply of air is distributed across the entire length of the wood fuel. Streams of air from the header pass under the log along paths for assuring combustion of log L2 while located between log L1. It has been found that the fuel wood undergoes substantially complete combustion whereby it is reduced to ash of a powder-like consistency. The ash is conveniently permitted to accumulate and form a heat storage bed below the fuel supporting surface of the rails so that the high temperature of the ash promotes combustion while assuring that all combustible constituents of the ash are consumed.

As shown in FIG. 4, an air-supply control plate 46 is adjustably positioned by rotation on a threaded shaft 47 extending from the end of the manifold which is located outside the firebox beyond the side wall 16. A portion of shaft 47 extends centrally into the manifold where a bent end is welded to the inner face of the manifold. A control handle 48 extends outwardly from the plate 46 for rotation of a nut member 49 which is welded to the plate 46. Since a negative draft is normally maintained in the combustion chamber by the chimney draft, air is drawn into the open end of the manifold under control provided by the position of the plate 46. As the air passes along the manifold within the firebox, the flow of air undergoes heating by conductive heat transfer since this section of the manifold is heated by the burning fuel. Typically, the streams of air discharged from the manifold have a temperature of the order of 400° F. and may, depending upon the construction of the stove and the particular temperatures developed therein, have a temperature of 600° F. The manifold arrangement permits safe control of the temperature developed in the stove during burning of fuel.

A further important feature of the present invention provides an improved construction of parts to form an access door. As shown in FIGS. 1, 5 and 6, an access door assembly 60 is carried by spaced-apart hinge members 61 supported by the front wall section 26 and attached to a lower bent edge portion of a door support flange 62. The flange 62 has a configuration to overlie the marginal surface area adjacent the access opening in the front wall. Conveniently, handles 63 project from each opposite lateral side of the door support flange. A centrally-arranged opening in the door support flange is surrounded by spacer walls 64 to project outwardly from the outer face surface of the door flange where they support a front wall 65 having an aperture therein. The aperture is closed by a suitably-dimensioned glass sheet 66, although glass strips may be used. The glass or other material used to form the closure for the aperture is selected to withstand high temperatures, typically up to 600° F. A support frame 67 engages the front frame to support the glass. A frame 68 carries a perforated deflector 68 such as wire mesh screen but preferably a thin, e.g., 1/16 inch, metal sheet with a multitude of holes therein. The deflector is supported within the spacer walls 64 at a site closely adjacent the opening in the door support flange. The deflector functions as a creosote catcher, a smoke deflector and a heat deflector to prevent deposits of smoke, creosote and other effluents on the glass. Additionally, to prevent such deposits, a series of spaced-apart openings is provided in the top wall of spacer walls 64 to supply air into the space between the glass and the screen. Preferably, the air is directed to wash across the inside face surface of the glass from where the air is drawn into the firebox to promote combustion therein. A baffle plate 70 is supported on the spacer wall to direct the airflow to the inner glass surface. This cools the glass. As shown in FIG. 1, manifold walls 71 form an enclosed air chamber attached to the back wall 14. Part of the air chamber extends above top wall 20 where openings direct streams of air across the top wall. The air chamber receives an air supply from a motor-driven blower 72. The air chamber can be mounted onto a wall of the stove at any convenient location to increase the flow of heat into an area of the dwelling.

Typically, in the operation of the stove apparatus according to the present invention, a fuel supply, while located on the rails, is ignited and caused to burn only by the supply of airstreams from the manifold. The use of a damper in the smoke pipe is essentially unnecessary since the combustion process is adequately and completely controlled by adjusting the supply of air fed into the firebox by the manifold. Alternatively, and during the nighttime hours or other times when the stove is normally unattended, it is preferred to stop the flow of air in the manifold by operation of the control plate and permit a reduced flow of air to enter the firebox through the openings in the top spacer wall of the door. The amount of air that can be introduced in this manner is less than the normal supply of air provided by the header pipe during daytime and early evening hours when greater quantities of heat are desired for the dwelling.

Figure 7:
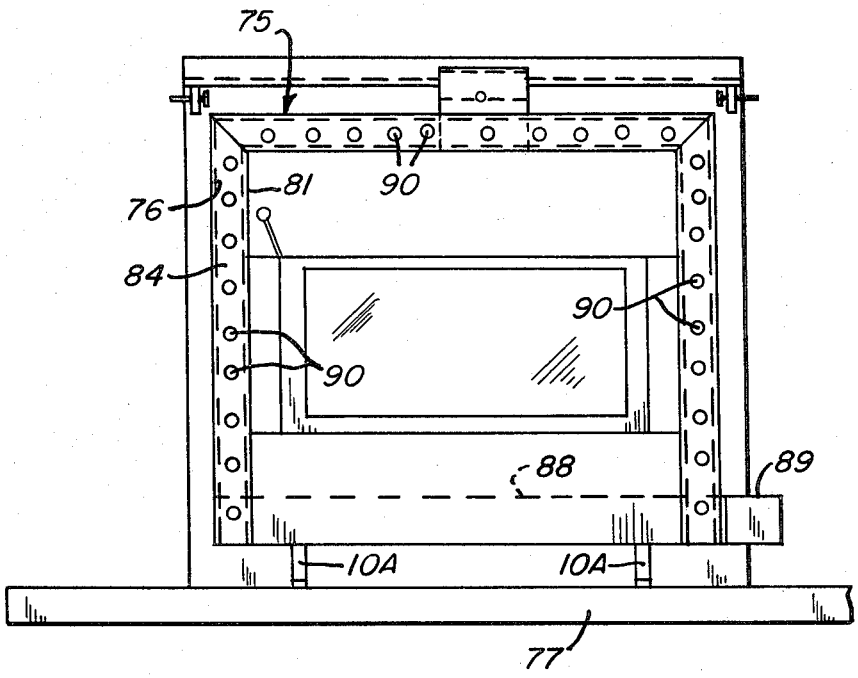
FIG. 7 is a front elevational view of the stove apparatus shown in FIG. 1 but including a modified form of an air manifold jacket for a fireplace installation.
Figure 8:
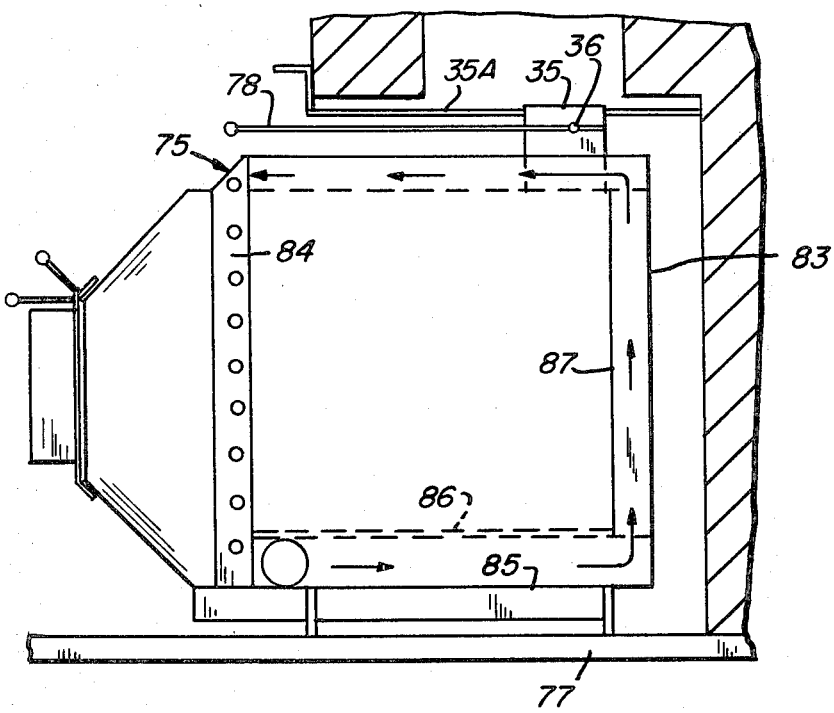
FIG. 8 is a side elevational view of the parts shown in FIG. 7.

In FIGS. 7 and 8, there is shown a modified form of an air chamber 75 having a generally U-shaped configuration to fit along the opposite outer side walls and across the top of the stove apparatus. It is within the scope of the present invention to embody the stove apparatus as described hereinbefore to fit within an opening 76 of a fireplace. Legs 10A have a reduced length in this instance for supporting the stove apparatus on a hearth 77. The smoke pipe 35 has a relatively short length since it is only necessary that the pipe extend through a cover plate 35A and communicate with a draft opening directly above the stove apparatus. An elongated control rod 78 extends to the damper assembly 36 for operation at a point conveniently located outwardly beyond the outer face of the fireplace. An airspace exists between the walls defining the opening 76 of the fireplace and the side walls 16 and 18, the top wall 20 and back wall 14 of the stove apparatus. The air chamber 75 includes parallel inner and outer walls 81 and 82 held in a spaced-apart relation by back and front walls 83 and 84, respectively. A manifold is formed in the depending bottom portion of each U-shaped leg of the manifold by a bottom wall 85 and a baffle plate 86, the latter having openings to direct an air supply from the manifold into the space between walls 81 and 82. A vertical baffle plate 87 directs air to the top section of the air chamber. Extending across the lower part of the back wall is an air-supply pipe 88 to deliver air from the manifold at the bottom of one leg of the air chamber to the manifold at the bottom of the other leg of the air chamber. A motor-driven fan 89 feeds air through an entry port into the manifold at one lower end of an air chamber leg. Hot air vents 90 are formed in the wall 84 to permit the discharge of heated air from the air chamber into the room of the dwelling. It is to be understood that the air chamber 75 can be used with equal success with the stove apparatus without the positioning thereof within the opening of a fireplace.

Although the invention has been shown in connection with a certain specific embodiment, it will be readily apparent to those skilled in the art that various changes in form and arrangement of parts may be made to suit requirements without departing from the spirit and scope of the invention.

I claim as my invention:

1. A stove apparatus for the combustion of solid fuel such as wood logs to provide heat for a dwelling or the like, said stove apparatus including the combination of stove walls including a floor wall joined together in a substantially airtight manner to form a firebox and a heat chamber thereabove, fuel carrier means including spaced-apart upstanding rails attached to said floor wall and extending in said firebox above said floor wall to support a fuel supply during burning, a lining of refractory brick in said firebox on said floor wall with said fuel carrier means extending above the refractory brick on the floor wall to permit the formation of an ash bed below the fuel, smoke pipe means coupled to an opening in one of said stove walls to carry away smoke and waste products of combustion, a hinged access door to normally close an opening on one of said stove walls to permit feeding the fuel into the firebox, an air-supply manifold pipe extending from rail-to-rail at one end portion in said firebox below said access door, said manifold pipe having a sealed end at one stove wall attached thereto for support, said manifold pipe extending through an opposed stove wall to said one stove wall for support thereby above said floor wall at an elevation in said firebox which is generally above said firebrick, said manifold pipe having a plurality of spaced-apart, air-discharge openings arranged to direct generally horizontal streams of heated air toward fuel on said fuel carrier means above and below the fuel support surface of said fuel carrier means, the flow of air in said air-supply manifold pipe being conductively heated by the air-supply manifold pipe within the firebox above said refractory brick for discharging streams of heated air from said air-discharge openings, and means to control the flow of air in said manifold pipe.

2. The stove apparatus according to claim 1 wherein said fuel carrier means further includes a metallic rail cover carried by each of said rails.

3. The stove apparatus according to claim 1 wherein said means to control the flow of air includes an adjustable cover plate outside said stove walls to vary the flow of air into said air-supply manifold.

4. The stove apparatus according to claim 1 wherein said access door includes a front wall surrounding an aperture therein, transparent means including a support to close the aperture in said front wall, a door support flange, and spacer side walls extending between said front wall and said door support flange.

5. The stove apparatus according to claim 4 wherein one of said spacer side walls includes at least one opening to supply air across the inside face surface of said transparent means.

6. The stove apparatus according to claim 5 further including a means to control the supply of air by the opening in said spacer side wall.

7. The stove apparatus according to claim 4, 5 or 6 further including a deflector arranged at a spaced and generally parallel relation to said transparent means for support by said door support flange.

8. The stove apparatus according to claim 1 wherein said stove walls include a front stove wall having an opening normally closed by said access door, and a door frame forming vertical and horizontal sides of the opening in said front stove wall, said air-supply manifold pipe extending between said fuel carrier means and the lower horizontal side of said door frame.

9. The stove apparatus according to claim 1 further including leg members to support said stove walls at a spaced relation above a support surface therefor.

10. The stove apparatus according to claim 1 further including an air chamber overlying part of at least one of said stove walls, and a blower coupled to said chamber to deliver a forced-air supply for dispersion of a conductively-heated air supply from said stove walls.

* * * * *